United States Patent [19]

Bowling et al.

[11] 4,109,226

[45] Aug. 22, 1978

[54] DISCONNECT SWITCH WITH RESET MECHANISM

[75] Inventors: Teamus Bowling, Fern Creek; Benjamin M. Thomson, Louisville, both of Ky.

[73] Assignee: General Electric Company, Louisville, Ky.

[21] Appl. No.: 773,195

[22] Filed: Mar. 1, 1977

[51] Int. Cl.[2] ..... H01H 71/18

[52] U.S. Cl. ..... 337/130; 337/140

[58] Field of Search ..... 335/166; 337/128, 129, 337/130, 139, 140, 382, 393, 395

[56] References Cited

U.S. PATENT DOCUMENTS

| | | | |
|---|---|---|---|
| 3,142,737 | 7/1964 | Brackett | 337/130 |
| 3,176,099 | 3/1965 | Bergsma | 337/140 X |
| 3,514,733 | 5/1970 | Staples | 337/140 X |
| 3,864,649 | 2/1975 | Doyle | 335/166 X |

*Primary Examiner*—George Harris
*Attorney, Agent, or Firm*—Francis H. Boos

[57] ABSTRACT

A disconnect switch or hot wire relay for use with a ground fault circuit interrupter in a power circuit to a load, such as an electric range, to provide ground fault protection for any circuit of the range. The switch has normally closed switch contacts, a biased actuator plunger for opening the contacts, a latching member for disabling the plunger, and an adjustable hot wire for releasing the latch and hence the plunger when the circuit is overloaded. The plunger of the switch is manually resettable from a remote position. The reset mechanism has an anti-tease or trip-free feature which prevents the operator from holding the disconnect contacts closed while a fault is present in the circuit.

8 Claims, 4 Drawing Figures

DISCONNECT SWITCH WITH RESET MECHANISM

CROSS-REFERENCE TO RELATED APPLICATION

This invention is a later improvement of the time delay disconnect switch of application Ser. No. 710,568 now U.S. Pat. No. 4,054,857 in the name of Teamus Bowling, which was filed on Aug. 2, 1976 and is assigned to the same assignee as the present invention.

BACKGROUND OF THE INVENTION

1. Field of the Invention

This invention relates to circuit breakers and hot wire relays for use in protecting a circuit from high leakage current or short circuits.

2. Description of the Prior Art

The present invention relates to a time delay disconnect switch or hot wire relay as one component of a ground fault circuit interrupter for use with an appliance such as an electric range to remove power for the purpose of preventing high current leakage hazards or short circuit damage. Such ground fault circuit interrupters (GFCI) are required by the Underwriters Laboratory, Inc., for use in bathrooms, with outdoor residential receptacles, swimming pools and the like.

The present invention is combined with a disconnect switch in the form of a hot wire relay of a special design to obtain time delay, as is described in the above-cited pending application. An example of a simple hot wire relay is shown in the Bergsma Patent No. 3,176,099 which uses an in-circuit self-heating resistance wire referred to as a "hot" wire or "sag" wire such that when the magnitude of the input current exceeds a certain limit the hot wire will elongate sufficiently for making or breaking the output circuit-controlling electrical contact.

Another example of a snap-action hot wire power-switching relay is described in the Staples U.S. Pat. No. 3,514,733, which is assigned to the assignee of the present invention. One of the main differences between the disconnect switch of the present invention and the Staples relay is the construction to provide time delay in the present disconnect switch to avoid spurious operation and distructive arcing and premature failure.

The Doyle U.S. Pat. No. 3,864,649 shows a ground fault circuit interrupter and its disconnect switch combined in a single wiring device, while in the present invention the disconnect switch is separate from the sensing and firing circuit.

The present disconnect switch employs wiping contact action which serves to maintain the contact surfaces clean, but this is not generally new, per se, as is depicted in the Sway U.S. Pat. No. 2,671,840 and the Hottenroth U.S. Pat. No. 2,350,960, both of which are assigned to the present assignee. It is felt that the present invention relates to a manual reset mechanism which can be operated from a remote position. This reset mechanism is such that it prevents the operator from holding the disconnect contacts closed while a fault is present in the circuit.

The principal object of the present invention is to provide a disconnect switch for use in a ground fault circuit interrupter system with a manual reset mechanism which may be operated from a remote position, but which is disabled whenever a fault is present in any circuit so as to prevent the operator from being able to hold the disconnect contacts closed.

A further object of the present invention is to provide a reset mechanism for a disconnect switch which cooperates with a latching mechanism for an actuator plunger that, when released by the latching mechanism, serves to open the switch contacts.

A further object of the present invention is to provide a reset mechanism of the class described which is carried by the latching mechanism and is movable with respect thereto for being able to cock the actuator plunger after the ground fault has been corrected.

SUMMARY OF THE INVENTION

The present invention, in accordance with one form thereof, relates to a ground fault disconnect switch for controlling the flow of current in a circuit and interrupting the flow in the event of a predetermined high current. The switch uses a thermal-responsive means for controlling a latch means which in turn controls a switch actuator means for opening normally closed switch contacts so that a predetermined current flow in a conductor causes the thermal-responsive means to release the latch means from engagement with the actuator means, thereby forcing the movable contacts open. A manual latch reset mechanism for cocking the actuator means is capable of remote control so that the disconnect switch can be reset from a position remote from the location of the disconnect switch. This reset mechanism is withdrawn from the actuator means when a ground fault is still present in the circuit so that the operator is unable to re-establish the circuit through the switch until the ground fault has been eliminated.

BRIEF DESCRIPTION OF THE DRAWINGS

This invention will be better understood from the following description taken in conjunction with the accompanying drawings and its scope will be pointed out in the appended claims.

DESCRIPTION OF THE PREFERRED EMBODIMENT

Figure 1:
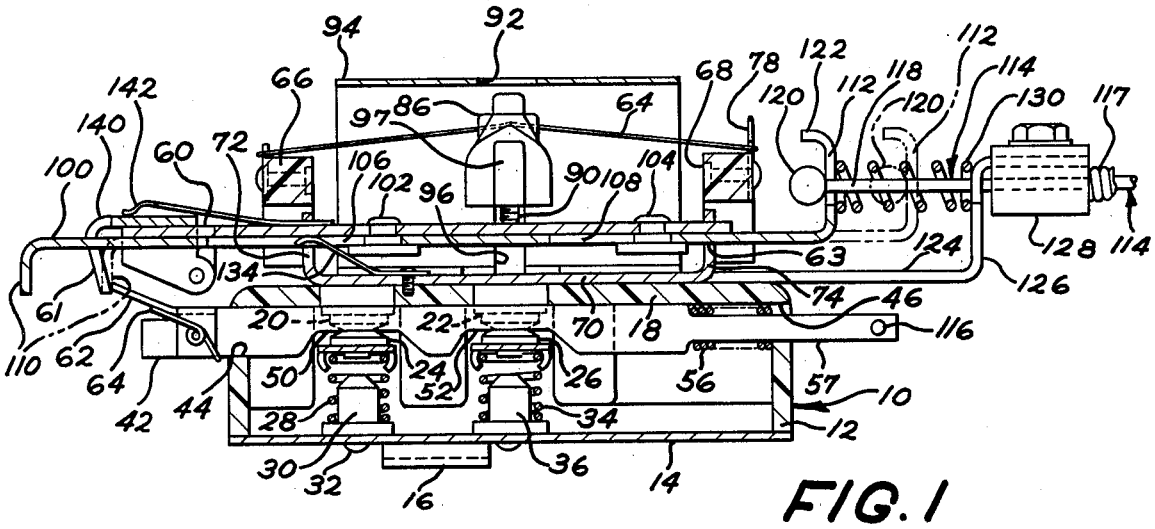
FIG. 1 is a cross-sectional elevational view of a disconnect switch of the present invention, showing the switch contacts in the normally closed position. A hot wire is shown in tension at the top of the switch, and it is furnished with an armature that bears down onto a latch member that in turn disables a spring-biased actuator plunger. When the latch member is released, the plunger will cause the movable contacts to open the circuit, as well as to de-energize the hot wire. Added to the latch mechanism is a manual, remote controlled reset mechanism.
Figure 4:
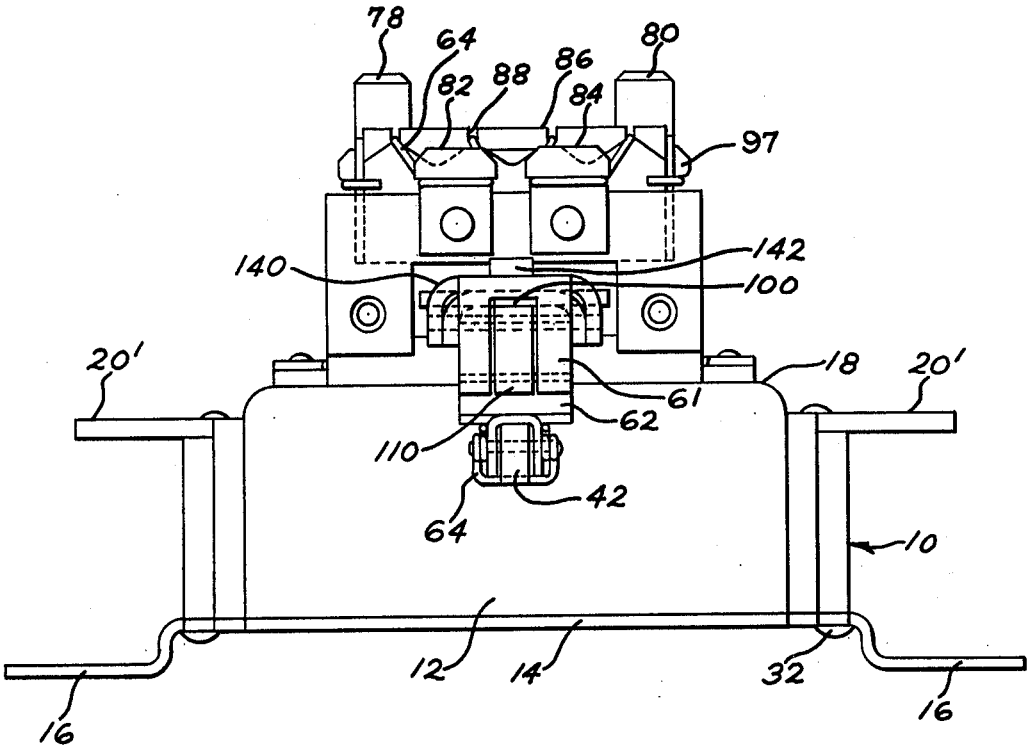
FIG. 4 is a left end view of the disconnect switch of FIG. 1 with the cover plate removed, showing the disconnect switch in its normal closed position.

Turning now to a consideration of the drawings, and in particular to FIG. 1, the disconnect switch 10 comprises a hollow insulating housing 12 that is open at the bottom and adapted to be closed by a flat metal cover plate 14, which plate has a pair of oppositely disposed mounting ears 16, as is best seen in FIG. 4. A large portion of the basic disconnect switch structure is described and claimed in the abovementioned pending application Ser. No. 710,568 now U.S. Pat. No. 4,054,857. Fixed to the underside of the top wall 18 of the housing 12 are two pairs of fixed contacts 20 and 22 which are each provided with a fixed terminal 20' and 22' respectively, which terminals extend outwardly from the side of the housing, as is best seen in FIG. 4. A movable contact bar 24 cooperates with the first pair of fixed contacts 20, and movable contact bar 26 cooperates with the second pair of fixed contacts 22. Each contact bar 24 and 26 is a bridging contact member which is spring-biased upwardly into a normally closed position with the mating fixed contacts, as is seen in FIG. 1. Contact bar 24 is seated on a central compression spring 28 that is in turn seated on an insulating post 30 that is attached to the cover plate 14 by a fastener 32. Similarly, the contact bar 26 is provided with a compression spring 34 that is seated on an insulating post 36.

The disconnect switch housing 12 is provided with an actuator plunger 42 of insulating material which is elongated so that it extends completely through the housing and out suitable openings 44 and 46 in the opposite end walls of the housing. This plunger is supported within these openings so that it is capable of sliding back and forth a limited amount within the housing. The actuator plunger 42 is a beam-like member that has a pair of recesses 50 and 52 in its lower edge so that when these recesses are positioned over the contact bars 24 and 26, respectively, the plunger is out of contact with the contact bars so that the biasing springs 28 and 34 are free to force the movable contact bars against the pairs of fixed contacts 20 and 22.

Each recess 50 and 52 is provided with an inclined ramp or cam surface which is adapted to act against the side of the related contact bar 24 and 26, respectively, for causing the contact bars to tilt or rock on their supporting springs 28 and 34, as the actuator plunger 42 is shifted back and forth through the housing. Thus, when the actuator plunger 42 is shifted to the left from the position of FIG. 1 to the position of FIG. 3, the movable contact bars 24 and 26 are forced downward by the inclined ramps until they assume the position shown in FIG. 3, where they are held separated from the fixed contacts. A biasing spring 56 is fitted over a reduced section 57 of the plunger at the right end thereof in FIG. 1 to bear against the adjacent end wall of the housing 12 to normally exert a pushing force on the plunger toward the left.

Figure 3:
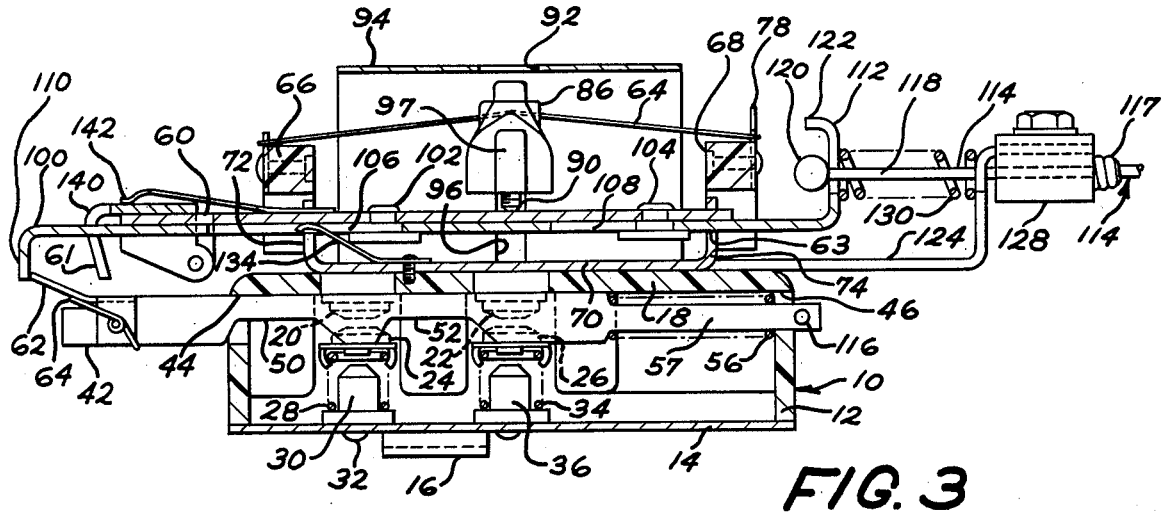
FIG. 3 is another cross-sectional elevational view of the disconnect switch showing the condition of the switch after the ground fault has been cleared to render the reset mechanism capable of restoring the actuator plunger to its latched position, as shown in FIG. 1.
Figure 2:
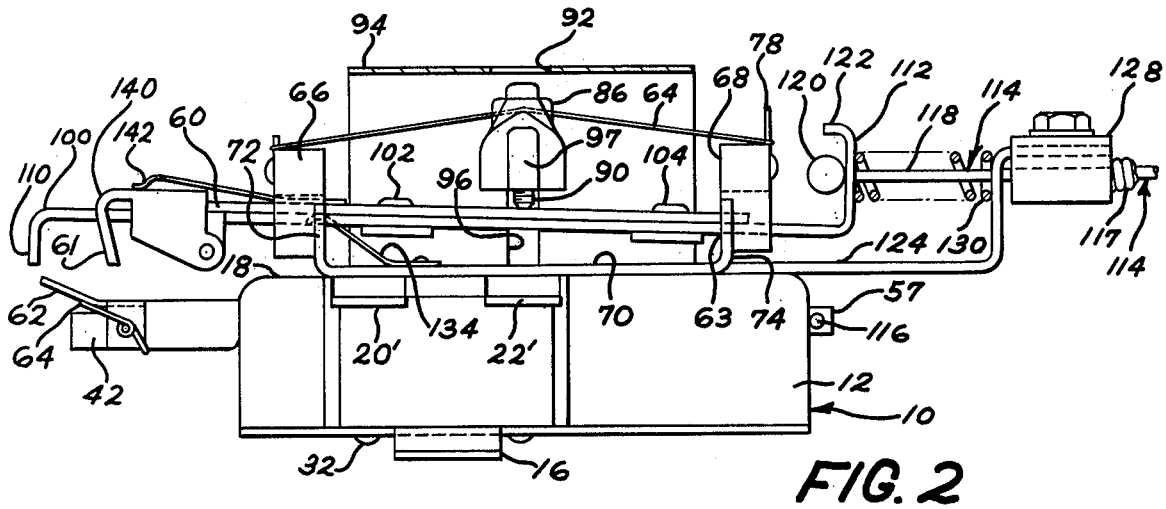
FIG. 2 is an instantaneous cross-sectional elevational view of the disconnect switch, similar to that of FIG. 1, after a ground fault has occurred and the hot wire has released the latch member, causing the actuator plunger to spring from right to left.

Since this disconnect switch 10 is provided with normally closed switch contacts, as is shown in FIG. 1, some means must be provided for disabling the actuator plunger 42. This disabling means is in the form of a biased latch member 60, which extends across the top of the switch housing and has a downturned finger 61 that cooperates with a pivoted pawl 62 that is fastened on the left end of the actuator plunger 42. The pawl 62 is provided with a torsion spring 64 for biasing the pawl into an upward position, as is shown in FIGS. 1–3.

This latch member 60 is a thin metal strip that is supported at a fulcrum point 63 adjacent the right side of the switch housing. Cooperating with the latch member 60 is a hot wire 64 of sinuous or looped configuration that is supported between a pair of insulating posts 66 and 68 at opposite ends of the housing. These insulating posts are supported from a metal base plate 70 that is attached to the top wall 18 of the switch housing 12. This base plate has turned-up end flanges 72 and 74 to which the insulating posts 66 and 68 are fastened, respectively. Thus, the fulcrum point 63 is formed by the turned-up flange 74 supporting the latch member 60. The insulating post 68 includes two vertical, spaced, terminal blades 78 and 80, as is best seen in FIG. 4. Thus, the hot wire 64 is connected at one end to the terminal blade 78 and then extends across the switch housing to a dummy metal terminal 82, as is seen in FIG. 4, and then extends back to the opposite side and is wrapped around a second dummy terminal and back again to the dummy terminal 84 and finally it is connected to the second terminal blade 80, as is well understood in this art.

An insulating armature 86 is interposed between the hot wire 64 and the latch member 60 so that any elongation or contraction of the hot wire 64 is reflected as a variable force bearing against the latch member 60. Notice in the end view of FIG. 4, the slotted nature of the top edge of the armature 86 for accommodating the hot wire 64 therethrough. These slots are identified by reference numeral 88. A calibrating screw 90 is threaded down through the armature 86 for bearing against the latch member 60. This calibration screw 90 is accessible through an access opening 92 in the a protective plate 94 for adjusting the tension on the hot wire so that the switch contacts will function at the exact control temperature. The position of the insulating armature 86 is stabilized by the cover plate 94 because the opposite walls of the cover plate are provided with vertical slots 96, as shown in FIG. 2, which receive side extensions 97 of the armature which slide therein.

The detailed nature of the disconnect switch 10 as described above is generally the same as in the copending patent application Ser. No. 710,568 now U.S. Pat. No. 4,054,857 which was identified above.

The present invention is related to a manual latch reset mechanism for cocking the actuator plunger 42 so as to disable the plunger under normal operating conditions so that the movable contact bars 24 and 26 will close with the fixed contacts 20 and 22. This reset mechanism includes a biased bar 100 that is carried by the latch member 60 and is slidable with respect thereto. The latch member includes a pair of rivet members 102 and 104 which extend into elongated slots 106 and 108, respectively, in the reset bar 100 so that these rivets support the reset bar 100 from the latch member 60 while allowing for limited longitudinal sliding movement therebetween. The left end of the reset bar 100 has a downturned hook formation 110 that is capable of engaging the pawl 62 of the actuator plunger 42, as is seen in FIG. 3. The opposite end of the reset bar 100 is provided with an upturned flange 112 to which an elongated choke cable 114 is attached. This choke cable 114 has an outer sheath 117 and an inner tension member 118 with a ball formation 120 on the end thereof which engages behind the flange 112 by slipping the tension member 114 down through a vertical slot 122 in the flange. The metal base plate 70 has a side extension 124 with a turned-up mounting flange 126 that is provided with a clamp member 128 for gripping the outer sheath 117 of the choke cable 114. The opposite end (not shown) of the choke cable 114 would probably be positioned in the control panel of the range in which this control is mounted. A coil spring 130 surrounds the tension member 118 in the area between the flange 112 of the reset bar 100 and the mounting flange 126. This choke cable 114 represents a remote controlled, manually operable means for moving the reset bar 100. This spring 130 biases the reset bar 100 to the left as is shown in FIGS. 1–3, but the bar 100 may be shifted to the right by pulling on the tension member 118, as is clear from the dotted line position of the flange 112 shown in FIG. 1.

Now comparing FIGS. 1 and 2, when a ground fault occurs in the circuit, the hot wire 64 will be energized instantaneously, causing it to heat up and become elongated which relaxes the downward pressure of the calibration screw 90 on the latch member 60. A leaf spring 134 is supported from the base plate 70, and it bears up against the underside of the reset bar 100 to urge the bar 100 and its supporting latch member 60 in an upward direction. Thus, when the hot wire 64 is elongated, the leaf spring 134 causes the combined latch member 60 and reset bar 100 to pivot about the fulcrum point 63 until the finger member 61 of the latch member 60 becomes disengaged from the pawl 62, thereby releasing the actuator plunger 42 so that its compression spring 56 may expand and shift the plunger to its left, extreme position of FIG. 2. A stop pin 116 is provided in the right end of the actuator plunger 42 to limit its free movement toward the left as the stop pin comes to bear against the end wall of the switch housing 12, as seen in both FIGS. 2 and 3.

When a circuit fault has been cleared, the combined latch member 60 and reset bar 100 will move down from the position of FIG. 2 to the position of FIG. 3, because the hot wire 64 will be de-energized and hence will tighten up causing the armature 86 to press down on the latch member 60 of FIG. 2 causing it to move to the position shown in FIG. 3. Thus, if the choke cable 114 were to be actuated, the hook 110 of the reset bar 100 would engage the pawl 62 of the actuator plunger 42 and the plunger would be cocked when the pawl 62 slips behind the finger of the latch member 60. Notice the latch finger 61 is part of a hinge formation 140 so that when the actuator plunger 42 is being cocked the pawl 62 will engage the finger 61 and pivot it upwardly so that the finger does not prevent the plunger from being cocked. A leaf spring 142 is fastened to the top of the latch member 60 and it bears down on the top of the hinge formation 140 so as to urge the finger 61 downward. This spring 142 permits the finger 61 to override the pawl 62 when the plunger 42 is being returned to its cocked or ON position.

Looking at the end view of FIG. 4, it will be noticed that the finger 61 of the latch member 60 is bifurcated to straddle the narrowed end of the reset bar 100 adjacent the hook 110. Thus, the hook 110 may move from its full-line position of FIG. 1 to its dotted-line position without interference from the finger 61 of the latch member 60.

Modifications of this invention will occur to those skilled in this art. Therefore, it is to be understood that this invention is not limited to the particular embodiments disclosed but it is intended to cover all modifications which are within the true spirit and scope of this invention as claimed.

What is claimed is:

1. A ground fault disconnect switch for controlling the flow of current in a circuit and interrupting the flow in the event of a predetermined high current, said switch comprising a housing with fixed and movable electric contact means for making and breaking the circuit, biasing means for holding the movable contact means in engagement with the fixed contact means, biased actuator means for forcing the movable contact means away from the fixed contact means, and latch means for disabling the actuator means, an adjustable thermal-responsive means acting upon the said latch means for holding the latch means in engagement with the said actuator means, whereby a predetermined current flow in the circuit causes the thermal-responsive means to release the latch means from engagement with the actuator means so the actuator means is free to open the switch contacts; the invention comprising a manual latch reset mechanism for cocking the actuator means so the actuator means is disabled, said reset mechanism including a remote controlled biased bar that is carried by the latch means and is movable with respect thereto.

2. The invention of claim 1 wherein the said biased bar is capable of limited longitudinal sliding action with respect to the latch means, one end of the bar having a hook means for engaging the adjacent end of the actuator means, the opposite end of the bar including an elongated tension means and biasing means for urging the bar in a direction toward the hook end of the bar.

3. The invention of claim 2 wherein the end of the latch means that is adjacent the hook end of the bar has a finger for engaging the adjacent end of the actuator means, while the adjacent end of the actuator means has a pawl that is adapted to be engaged by either the hook end of the bar or the finger of the latch means, said pawl being slidable under the finger when the bar is cocking the actuator means.

4. The invention of claim 3 wherein the switch housing includes a support surface for the latch means at the end opposite the latch finger whereby when the thermal-responsive means releases the latch means, the latch means pivots about this support surface and the finger disengages itself from the pawl of the actuator means.

5. The invention of claim 4 wherein spring means on the switch housing remote from the said support surface maintains contact of the latch means with respect to the thermal-responsive means.

6. The invention of claim 5 wherein the said latch finger is a bifurcated spring-biased pivotal member that straddles the hook end of the reset bar.

7. The invention of claim 1 wherein there is a lost motion pin and slot connection means holding the reset bar on the latch means.

8. The invention of claim 1 wherein the said actuator means is a spring-biased plunger that extends through the housing and has a pawl adjacent one end thereof, and said latch means is an elongated beam external of the housing which generally overlies the plunger and has a bifurcated spring-biased pivotal member on its end for cooperation with the pawl of the actuator plunger, and which straddles the reset bar, the adjacent end of the reset bar having a hook also for engaging the pawl of the actuator plunger.

* * * * *